US005309576A

United States Patent [19]

Broersma

[11] Patent Number: 5,309,576

[45] Date of Patent: May 10, 1994

[54] MULTIPLE DENSITY HELMET BODY COMPOSITIONS TO STRENGTHEN HELMET

[75] Inventor: Lester V. Broersma, Bellflower, Calif.

[73] Assignee: Bell Helmets Inc., Cerritos, Calif.

[21] Appl. No.: 717,485

[22] Filed: Jun. 19, 1991

[51] Int. Cl.[5] ..... A42B 3/02

[52] U.S. Cl. ..... 2/412; 2/425

[58] Field of Search ..... 2/412, 425, 411, 410, 2/424, 171.3, 181.6, 414; 428/316.6

[56] References Cited

U.S. PATENT DOCUMENTS

| | | | |
|---|---|---|---|
| 2,908,943 | 10/1959 | Miller | 2/410 X |
| 3,327,316 | 6/1967 | Pukish, Jr. | 2/425 X |
| 3,500,473 | 3/1970 | Marchello | 2/412 |
| 3,501,772 | 3/1970 | Wyckoff | 2/425 |
| 3,797,040 | 3/1974 | Caldwell | 2/425 X |
| 4,006,496 | 2/1977 | Marker | 2/414 |
| 4,075,717 | 2/1978 | Lemelson | 2/412 |
| 4,115,874 | 9/1978 | Hasegawa | 2/425 |
| 4,134,155 | 1/1979 | Robertson | 2/412 |
| 4,446,576 | 5/1984 | Hisataka | 2/425 |
| 4,612,672 | 9/1986 | Schrack | 2/425 |
| 4,710,984 | 12/1987 | Asper et al. | 2/412 |
| 4,744,107 | 5/1988 | Fohl | 2/424 |
| 4,821,345 | 4/1989 | Marchello | 2/425 |
| 4,845,786 | 7/1989 | Chiarella | 2/412 |
| 4,970,729 | 11/1990 | Shimazaki | 2/414 |

*Primary Examiner*—Peter Nerbun
*Attorney, Agent, or Firm*—William W. Haefliger

[57] ABSTRACT

A protective helmet having a dome-shaped body and air vent structure in the body comprising a body consisting of molded, synthetic resin sections, a first the section having relatively higher density and a second the section having relatively lower density; the first section extending in strengthening adjacency to the second section, laterally of the vent structure.

22 Claims, 4 Drawing Sheets

FIG. 3.
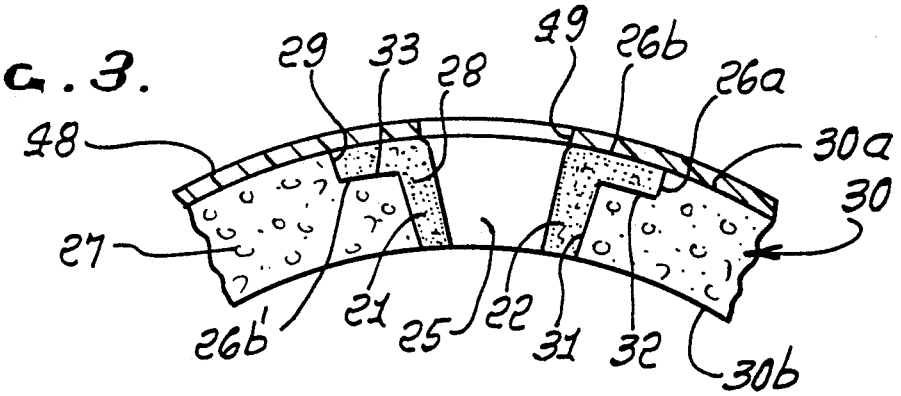
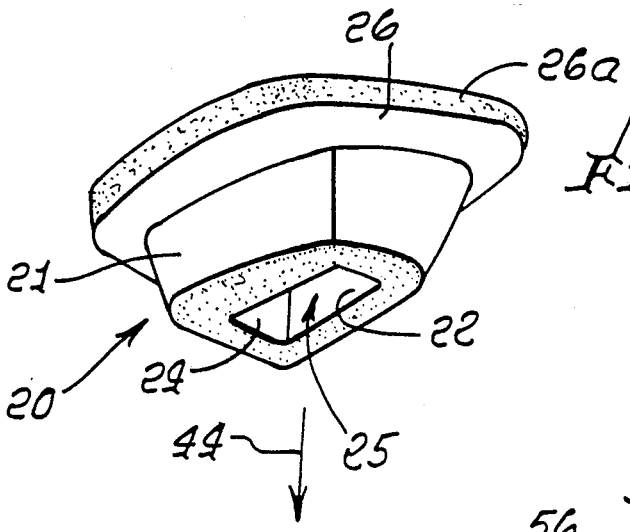
FIG. 5.
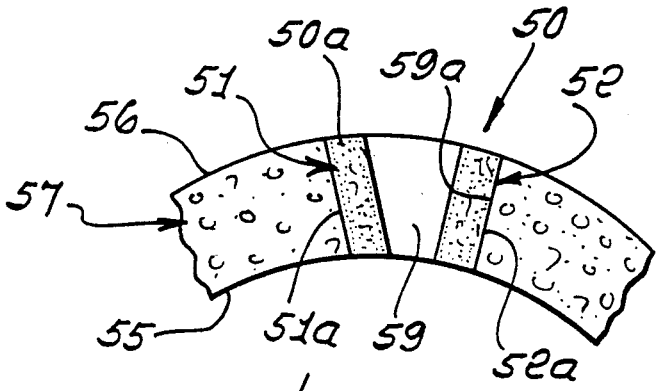
FIG. 6.
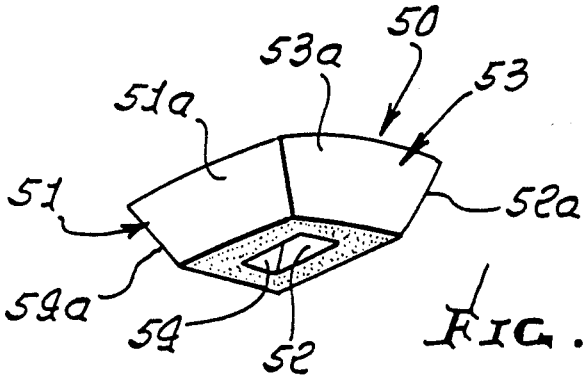
FIG. 6a.

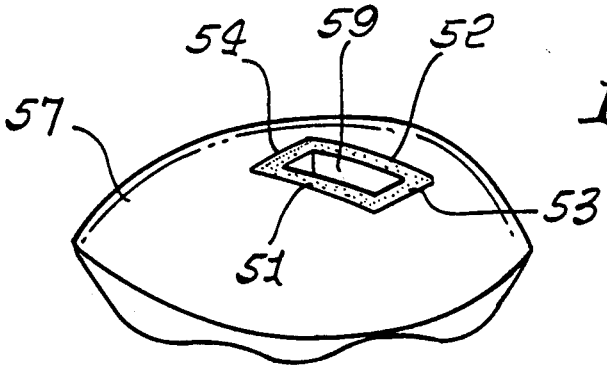
FIG. 7.
FIG. 8.
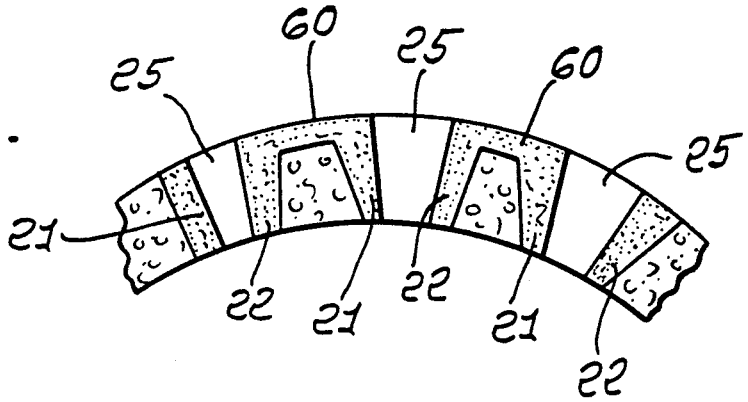
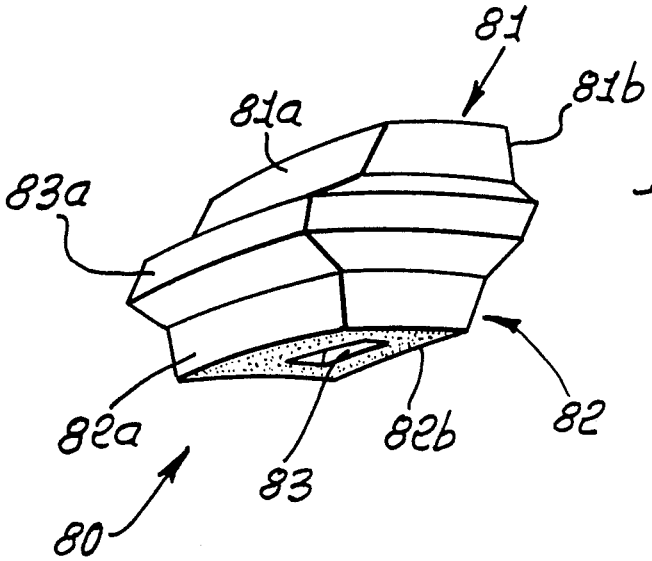
FIG. 9.

MULTIPLE DENSITY HELMET BODY COMPOSITIONS TO STRENGTHEN HELMET

BACKGROUND OF THE INVENTION

This invention relates generally to helmets, and more particularly to helmet structures worn by cyclists and consisting of different density materials, as for example foamed synthetic resin.

Safety helmets, as worn by bicyclists, motorcyclists, skaters, and others, typically employ a thick (20 to 50 mm) layer of crushable, synthetic resin foam, extending over and about the wearer's head to mitigate impact. In many designs, ventilation openings or holes are formed to extend in or through the helmet body. It was found that such holes reduced the impact strength of the helmet body, and particularly proximate the holes. In order to prevent reduction in impact strength, a stiff, outer shell was employed, the helmet body itself would be made thicker, or the entirety of the crushable foam would be made of higher density material. However, all of these approaches increase substantially the overall weight of the helmet. No way was known to achieve increased strength, without increasing helmet body thickness or weight.

SUMMARY OF THE INVENTION

It is a major object of the present invention to provide a solution to the above problems and difficulties, and in a manner such as to achieve increased strength, particularly at or proximate vent means, while maintaining an overall relatively lightweight construction, for comfort.

Basically, the helmet has a dome-shaped body and air vent means in the body, and is characterized by:

a) the body consisting of molded, synthetic resin sections, a first section having relatively higher density and a second section having relatively lower density, b) the first section extending in strengthening adjacency to the vent means.

As will appear, the first section may extend in bounding relation to the vent means, such as multiple air vents through the body. In this configuration, the second section of lower density may face the helmet interior, as by molding it against the previously molded first section of higher density. In this regard, the first section may form recesses into which the material of the second section is received, as during molding. In addition, the first section may include a rib or ribs penetrating into the material of the second section. The second section of lower density then provides greater cushioning adjacent the wearer's head, as during a high impact.

Another object is to reinforce the area or areas around or proximate ventilation holes in a safety helmet foamed plastic body, by employment of relatively stiffer foam plastic inserts. The separately molded stiffer inserts can be molded into the foam layer matrix, or they can be bonded into recesses in the foam body matrix after the latter has been molded.

A further object is to provide increased stiffness of foam plastic inserts, as referred to, by employing higher density foam, for example of the same general type or composition as the overall foam body matrix. The insert foam can be made to have a contrasting color and shaped to enhance the styling of the helmet. Such inserts can be made to extend from the outer surface of the overall matrix or body, to the inner surface of that body, so that proximate the vent or vents, the helmet impact strength is raised to the level of the higher density foam material, yet the desired lightweight character of the helmet has been maintained.

Another object includes the provision of multiple inserts defining walls of the vent means. Such inserts may include flanges projecting away from the vent means to enhance attachment to the foamed resinous matrix material. The helmet body thus formed and strengthened may be received in a hard, outer shell if desired, or it may be employed without such an outer shell.

Yet another object is the provision of a method of forming the dual density material helmet, as referred to. The method of the invention may typically include first molding the first section of higher density about vent openings; and thereafter molding the second section of foamed synthetic resin of lower density, the second section molded against the first section. In this regard, the first section may define inserts, as referred to above, and against which the material of the second section is molded.

These and other objects and advantages of the invention, as well as the details of an illustrative embodiment, will be more fully understood from the following specification and drawings, in which:

DRAWING DESCRIPTION

FIG. 3 is a view like FIG. 2 showing a high density, foam plastic insert defining an air vent, in a helmet lower density, foam plastic matrix;

FIG. 5 is a perspective view of the higher density foam plastic insert;

FIG. 6 is a section like FIG. 3 showing another insert configuration;

Figure 10:
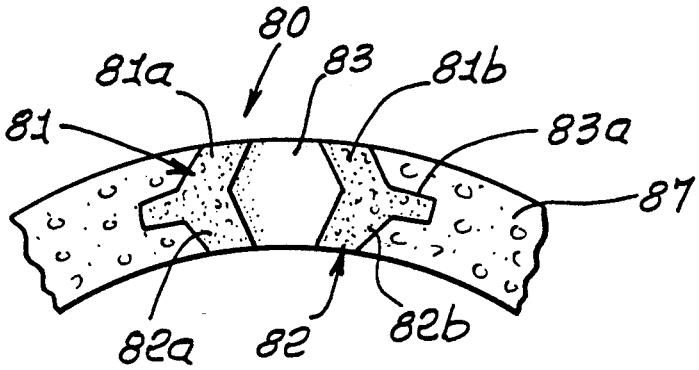
Figure 11:
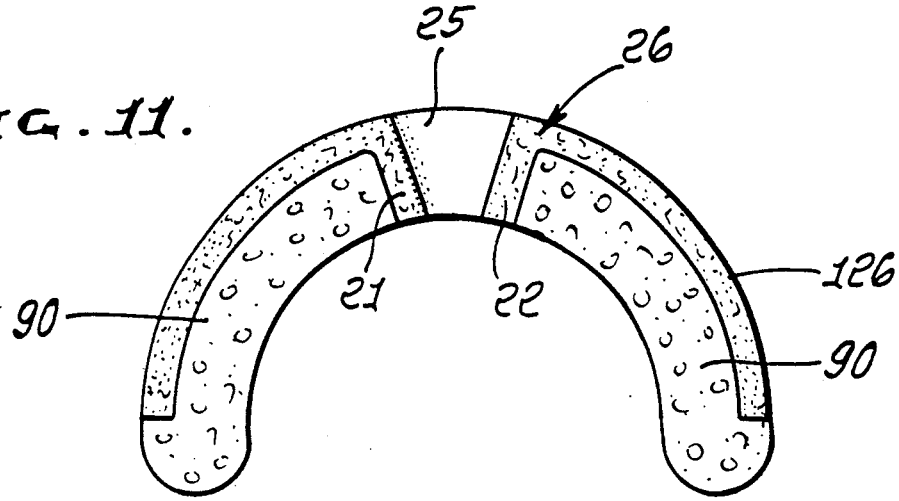
Figure 12:
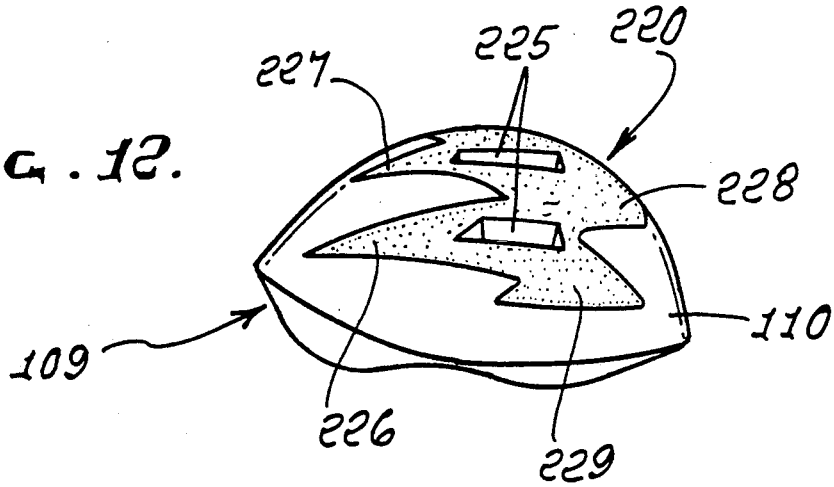

FIG. 6*a* is a perspective view of the FIG. 6 insert;

FIG. 7 is a perspective view of a helmet containing the FIG. 6 insert;

FIG. 8 is a view like FIG. 6 showing an insert defining multiple vents;

FIG. 9 is a perspective view of a modified insert;

FIG. 10 is a section like FIG. 6 showing a further modified insert;

FIG. 11 is a section like FIG. 6 showing yet another insert configuration; and FIG. 12 is a perspective view of a helmet containing a styled insert, defining vent means.

DETAILED DESCRIPTION

Figure 1:
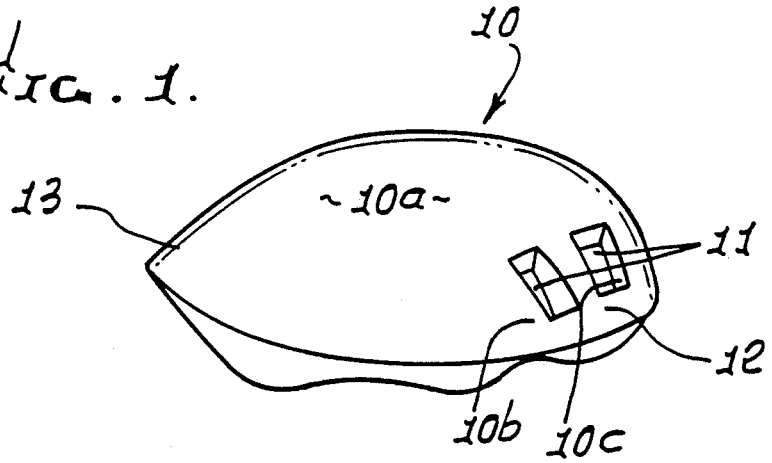
FIG. 1 is a perspective view of a helmet with air vents.

In FIG. 1, a dome-shaped helmet 10 has elongated vent openings 11 extending longitudinally generally intermediate front and rear ends 12 and 13 of the helmet. The helmet body 10*a* consists of lightweight, synthetic resin foam uniformly occupying the space between the outer and inner surfaces 10*b* and 10*c* of the body. An example of the body material is polystyrene bead expandable during molding, at a density of 65 grams per liter.

Figure 2:
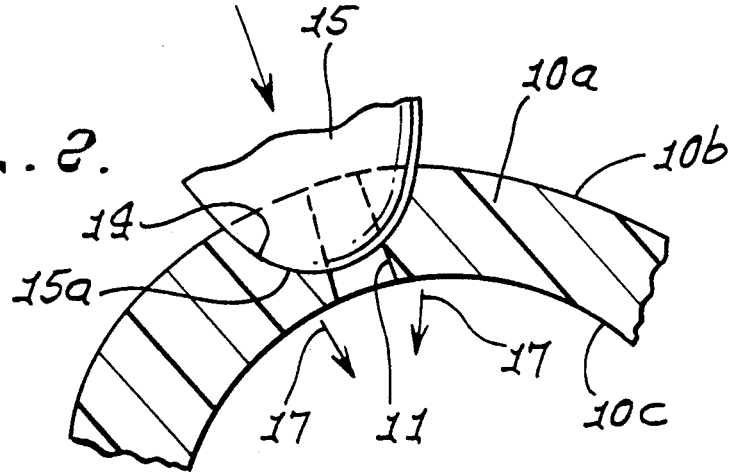
FIG. 2 is an enlarged section taken through a helmet of uniform composition, showing crushing of an air vent, under impact loading.

FIG. 2 shows the crushed condition at 14 of the foam under impact loading of an object 15, whereby the crushed material is displaced at the forward surface 15*a* of the object, broken lines indicating the original position of the foam material. The vent 11 weakens the structure to enable a undesirable extent of crushing, which can lead to inward failure displacement of the helmet matrix material, as indicated at arrows 17.

Turning to FIGS. 3 and 5, they show the provision of a synthetic resin foam insert 20 for us in the helmet matrix. The molded insert includes a base portion defining elongated side walls 21 and 22, and opposite ends walls 23 and 24, forming a looping skirt about a vent opening 25 A flange 26 is integral with the upper ends of those walls, and extends outwardly to a periphery 26*a* extending in a loop larger than the loop formed by walls 21–24. The flange thickness may vary but is shown as about equal to the thicknesses of the walls 21–24.

In FIG. 3, the matrix material of the helmet is indicated at 27, and as forming a relatively smaller recess 28 to closely receive the insert skirt defined by walls 21–24, and as forming a relatively larger recess 29 to closely receive the insert flange periphery 26*a*. In this regard, the top surface 26*b* of the flange may be flush, or approximately flush, with the outer surface 30*a* of the molded matrix material 30. Thus, looping recess wall surfaces 31 and 32 define openings larger than the vent opening 25; surface 31 intersects the inner surface 30*b* of the matrix body; surface 32 intersects the body outer surface 30*a;* and a load-receiving step shoulder 33 extends between surfaces 31 and 32 and seats the inner surface 26*b* of flange 26, to transfer and distribute impact loading to the body 30.

The insert may be pre-molded, and then inserted into the matrix 30, to be adhesively (structurally) joined to the surfaces 31, 32 and 33. Alternatively, the insert may be molded in situ after pre-molding of the body 30, or vice versa.

In any event, the density of the insert 20 foam material is substantially in excess of that of the matrix material 30. For example, the density of the insert material is between about 85 and 120 grams per liter, and preferably about 100 grams per liter; whereas, the density of the matrix material 30 is between about 50 and 75 grams per liter, and preferably about 65 grams per liter. Thus, the insert material has greater crush resistance and is stronger and stiffer than the matrix material. The body 10*a* and insert 20 structures may be considered as cellular.

Figure 4:
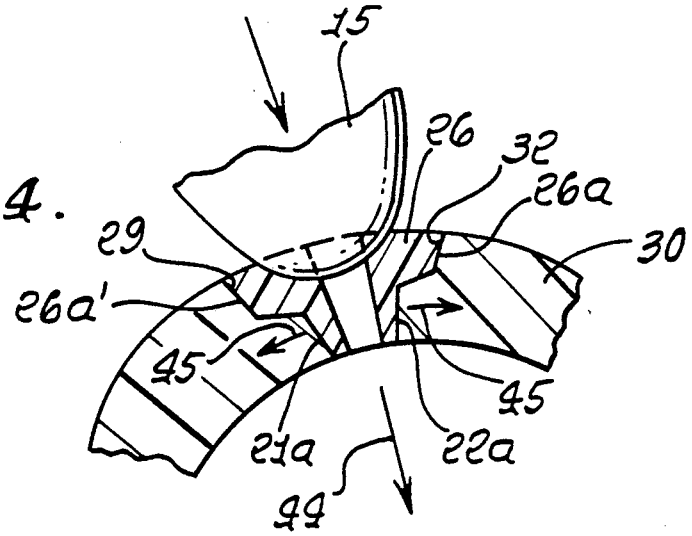
FIG. 4 is a view like FIG. 3 but showing conditions upon impact loading of the helmet at the insert and air vent location.

FIG. 4 shows less penetration of the impacting body 15 into the insert material (as compared with penetration of the same body 15 into the matrix material in FIG. 2), the body momentum relative to the helmet being the same in both instances. Note also the distribution of the transferred impact load by the flange 26 to a wider area of the matrix body 30 in FIG. 4. Outer surfaces 21*a*–24*a* of the walls 21–24 typically taper in direction 44, whereby distributed wedge loading is transferred, as in lateral directions indicated by arrows 45, upon impact of a body 15, as in FIG. 4. Tapering of the flange surfaces 26*a* and 26*a'* in direction 45 adds to such load lateral transfer effect.

As seen in FIG. 3, the resultant reinforced helmet body may be inserted into an outer hard shell 48 with vent openings 49 in alignment with the vents defined by the insert or inserts.

The impact resistance of a layer of foam is proportional to its volume times its density. In a ventilation hole, there is no impact resistance. In an area of 100 square centimeters having a thickness of 3 centimeters, a foam layer of 65 grams per liter would weigh 19.5 grams and have a certain crush resistance. In another equal area, but having a ventilation hole with an area of 35 square centimeters, the crush resistance would be reduced by 35%. The present invention enables placement of a 100 gram per liter insert around the hole having an area of 65 square centimeters, for example. As a result, the overall 100 square centimeter area has the same 19.5 grams of foam and has the same crush resistance as an area without the hole but made of 65 grams per liter foam. Outwardly surrounding areas remain at 65 grams per liter, in this example.

It should be understood that dome-shaped helmets fitted to dome-shaped heads and impacted by objects of various shapes have non-linear requirements with respect to their area. Consequently, the density and area of the inserts may be higher or lower than the example given above.

FIGS. 6, 6*a*, and 7 show a molded insert 50 which is like that of FIG. 3, except that the flange 26 is eliminated. Uppermost portion 50*a* of that insert performs, at least in part, the functions of flange 26, due to the load bearing and distributing tapered looping outer surfaces 51*a* and 52*a* of side walls 51 and 52, and tapered looping outer surfaces 53*a* and 54*a* of end walls 53 and 54. Walls 51–54 are elongated (in front-to-rear helmet direction) between the inner and outer surfaces 55 and 56 of the helmet body 57. Insert 50 is made of higher density material, as referred to above, and body 57 is made of the lower density material, as referred to above. Walls 51–54 form a tapered vent 59. The insert 50 may be molded in situ in body matrix 57, or molded separately and bonded in place in recess 59*a*.

FIG. 8 illustrates a modification in which multiple flanged inserts, as described in FIGS. 3 and 4, are integrated via their flanges to define a single "flange" outer section 60 overlying inner matrix section 27, at multiple vent locations, or wider areas.

In FIGS. 9 and 10, the modified insert 80 looping opposite side walls 81 and 82, define a vent opening 83. The side walls diverge at sections 81*a* and 82*a*, and converge at sections 81*b* and 82*b;* also, a looping flange 83*a* is integral with those side walls and projects laterally outwardly into the matrix material 87, the flange providing load transfer and distribution functions. The divergent-convergent shapes of the side walls 81 and 82 also effect transfer of impact loading directionally laterally away from the vent and into the matrix material 87, adding to shock and impact load resistance (i.e., strength) of the overall helmet.

FIG. 11 shows an extension 126 of the flange 26 of FIG. 3 to project over substantial top, side and end domed extents 90 of the helmet body.

FIG. 12 shows an insert 220 like insert 20 of FIG. 3, except that the flange 26 is extended laterally in a cosmetically stylized manner, i.e., to define tapered flange zones 226–229, extending forwardly and rearwardly on or in the matrix body 110 of the helmet shown. See vents 225.

In each of the focuses of the invention described, the inserts may be formed to have color or colors contrasting with the color of the matrix material.

I claim:

1. In a protective helmet having a dome-shaped body and air vent means in said body, the helmet comprising, a body consisting of molded, foamed, synthetic resin sections, a first said section having relatively higher density and a second said section having relatively lower density, said first section extending in strengthening adjacency to said second section, laterally of said vent means, and said first section having a flange penetrating into the second section, in bounding relation to the vent means, to strengthen the second section proximate the vent means, the second section forming a recess into which the first section is received during molding, said flange of said first section having a top surface which is substantially flush with the outer surface of said second section.

2. The combination of claim 1 wherein said first section extends in bounding relation to said vent means.

3. The combination of claim 2 wherein said vent means includes multiple air vents through said body, and said first section bounds each of said multiple vents.

4. The combination of claim 1 wherein said body has a user's head receiving interior, said second section of lower density facing said interior

5. The combination of claim 3 wherein said second section extends in face-to-face relation with said first section, the one section molded in place after the other section is molded in place.

6. The combination of claim 5 wherein the second section forms a recess into which the first section is received.

7. The combination of claim 5 wherein the first section has flange means penetrating into the second section, to strengthen the second section.

8. The combination of claim 7 wherein said flange means projects away from the vent means.

9. The combination of claim 1 wherein the first section defines a layer facing outwardly away from the helmet interior.

10. The combination of claim 1 wherein said first section comprises at least one insert defining walls of said vent means.

11. The combination of claim 10 wherein said first means includes a flange extending in a loop about said vent means and also away from said vent means.

12. The combination of claim 1 wherein said sections consist of foamed synthetic resin, the first section having density between about 85 and 120 grams per liter, and the second section having density between 50 and 75 grams per liter.

13. The combination of claim 1 including a helmet shell of relatively hard material into which said body is received as a liner.

14. The method of forming a helmet having a dome-shaped body and air vent means in said body, said body consisting of molded, foamed, synthetic resin sections, a first said section having relatively higher density and a second said section having relatively lower density, said first section extending in strengthening adjacency to said second section, laterally of said vent means, and said first section having a flange penetrating into the second section, in bounding relation to the vent means, to strengthen the second section proximate the vent means, the second section forming a recess into which the first section is received during molding, the flange having a top surface, said method including first molding said first section, and thereafter molding, said second section molded against said first section wherein said step of molding said second section against said first section comprises molding the outer surface of said second section into substantially flush relation with said flange top surface.

15. The method of forming a helmet having a dome-shaped body and air vent means in said body, said body consisting of molded, foamed, synthetic resin sections, a first said section having relatively higher density and a second said section having relatively lower density, said first section extending in strengthening adjacent to said second section, laterally of said vent means, and said first section having a flange penetrating into the second section, in bounding relation to the vent means, to strengthen the second section proximate the vent means, the second section forming a recess into which the first section is received during molding, said flange having a top surface, said first section comprising at least one insert defining walls of said vent means, said method including molding said second section in position to contact said insert, said insert consisting of foamed synthetic resin, wherein said step of molding said second section in a position to contact said insert comprises molding the outer surface of said second section into substantially flush relation with said flange top surface.

16. In a dome-shaped cyclist helmet having a thick layer of crushable foam pierced with ventilation holes, foam inserts surrounding the holes and effectively penetrating from the outer surface of said layer to the inner surface of said layer, said foam inserts having a higher stiffness than the surrounding foam layer, each foam insert having a flange penetrating into said layer, the flange having a top surface extending in substantially flush relation with said outer surface of said layer.

17. The combination of claim 1 wherein the first section is cosmetically shaped and made in a first color contrasting to the color of the second section.

18. In a protective helmet having a dome-shaped body and air vent means in said body, the helmet comprising, a body consisting of molded, synthetic resin, a first body section having a flange and having a first color simulative of relatively higher density and a second body section having a second color simulative of relatively lower density, said first section extending in adjacency to said vent means, said flange portion of said first section having a top surface which is substantially flush with the outer surface of said second section.

19. In a protective helmet having a dome-shaped body and air vent means in said body, the helmet comprising, a body consisting of molded, cellular, synthetic resin sections, a first said section having relatively higher density and a second said section having relatively lower density, said first section extending in strengthening adjacency to said second section, laterally of said vent means, and said first section having a flange penetrating into the second section, in bounding relation to the vent means, to strengthen the second section proximate the vent means, the second section forming a recess into which the first section is received during molding, the second section having an outer surface, said flange of said first section having a top surface which is substantially flush with the outer surface of said second section.

20. In a protective helmet having a dome-shaped body and air vent means in said body, communicating with the hollow interior of the helmet, the helmet comprising, a body consisting of molded, foamed, synthetic resin sections, a first said section having relatively higher density and a second said section having relatively lower density, said sections having the same foamed, synthetic resin composition, said first section extending in strengthening adjacency to said second section, laterally of said vent means, and said first section having a flange portion penetrating into the second section, in bounding relation to the vent means, to strengthen the second section proximate the vent means, the second section forming a recess into which the first section is received during molding, the periphery of said first section converging in a direction between the exterior of the helmet and said helmet interior to transfer impact loading laterally from the first section to said second section, said flange portion of said first section having a top surface which is substantially flush with the outer surface of said second section.

21. The method of forming a helmet having a dome-shaped body and air vent means in said body, communicating with the hollow interior of the helmet, said body consisting of molded, foamed, synthetic resin sections, a first said section having relatively higher density and a second said section having relatively lower density, said sections having the same foamed, synthetic resin composition, said first section extending in strengthening adjacency to said second section, laterally of said vent means, and said first section having a flange portion penetrating into the second section, in bounding relation to the vent means, to strengthen the second section proximate the vent means, the second section forming a recess into which the first section is received during molding, said method including first molding said first section to have an inner peripheral side adjacent said vent means and an outer peripheral side, and thereafter molding said second section against said first section outer peripheral side, wherein said outer peripheral side of the first section converges in a direction between said helmet exterior and the helmet interior to transfer impact loading laterally from the first section to the second section, said flange portion of said first section having a top surface which is substantially flush with the outer surface of said second section wherein said step of molding said second section against said first section outer peripheral side comprises molding the outer surface of said second section into substantially flush relation with said flange top surface.

22. The helmet of claim 1 wherein the helmet includes a shell into which the body is received.

* * * * *